United States Patent [19]

Hietikko

[11] 4,258,672

[45] Mar. 31, 1981

[54] VARIABLE LIFT CAMMING APPARATUS AND METHODS OF CONSTRUCTING AND UTILIZING SAME

[76] Inventor: Calvin N. Hietikko, 2186 Glenshire, Pontiac, Mich. 48055

[21] Appl. No.: 953,020

[22] Filed: Oct. 20, 1978

[51] Int. Cl.[3] ..... F01L 1/34

[52] U.S. Cl. ..... 123/90.18; 123/90.12

[58] Field of Search ..... 123/90.12, 90.18, 90.14; 251/57

[56] References Cited

U.S. PATENT DOCUMENTS

| | | | |
|---|---|---|---|
| 997,253 | 7/1911 | Hesselman | 123/90.18 |
| 1,043,500 | 11/1912 | Bachrich | 123/90.12 |
| 1,050,087 | 1/1913 | Steinbecker | 123/90.12 |
| 2,069,587 | 2/1937 | Mattern | 123/90.18 |
| 2,306,131 | 12/1942 | Lossau | 123/90.12 |
| 2,827,884 | 3/1958 | Stivender | 123/90.12 |
| 3,209,737 | 10/1965 | Omotehara et al. | 123/90.12 |
| 3,382,854 | 5/1968 | Steiner | 123/90.16 |
| 3,612,015 | 10/1971 | Hausknecht | 123/90.12 |
| 3,668,871 | 6/1972 | Berndt et al. | 251/57 |
| 3,683,874 | 8/1972 | Berlyn | 123/90.12 |
| 3,730,150 | 5/1973 | Codner, Jr. | 123/90.18 |

OTHER PUBLICATIONS

Norbye, Variable Valve Timing and Rotary Valves, Road and Track, Apr. 1977, pp. 121–125.

*Primary Examiner*—Charles J. Myhre
*Assistant Examiner*—W. Wolfe
*Attorney, Agent, or Firm*—Irving M. Weiner; Pamela S. Burt; John L. Shortley

[57] ABSTRACT

A variable lift camming apparatus for controlling the intake and exhaust valves associated with the combustion chambers of an internal combustion engine. The apparatus provides a wide range of valve lift opening movements and a wide range of valve opening duration periods and affords flexibility in valve timing. The apparatus includes a specially-contoured intake cam member and exhaust cam member, both mounted for axial sliding movement on a splined shaft, with the cam members being shifted to selected positions in response to the speed of the engine. Camming action is transmitted from the cam members to the valves by a valve operating system which includes a hydraulic cam-action transmitting member.

7 Claims, 8 Drawing Figures

FIG. 4
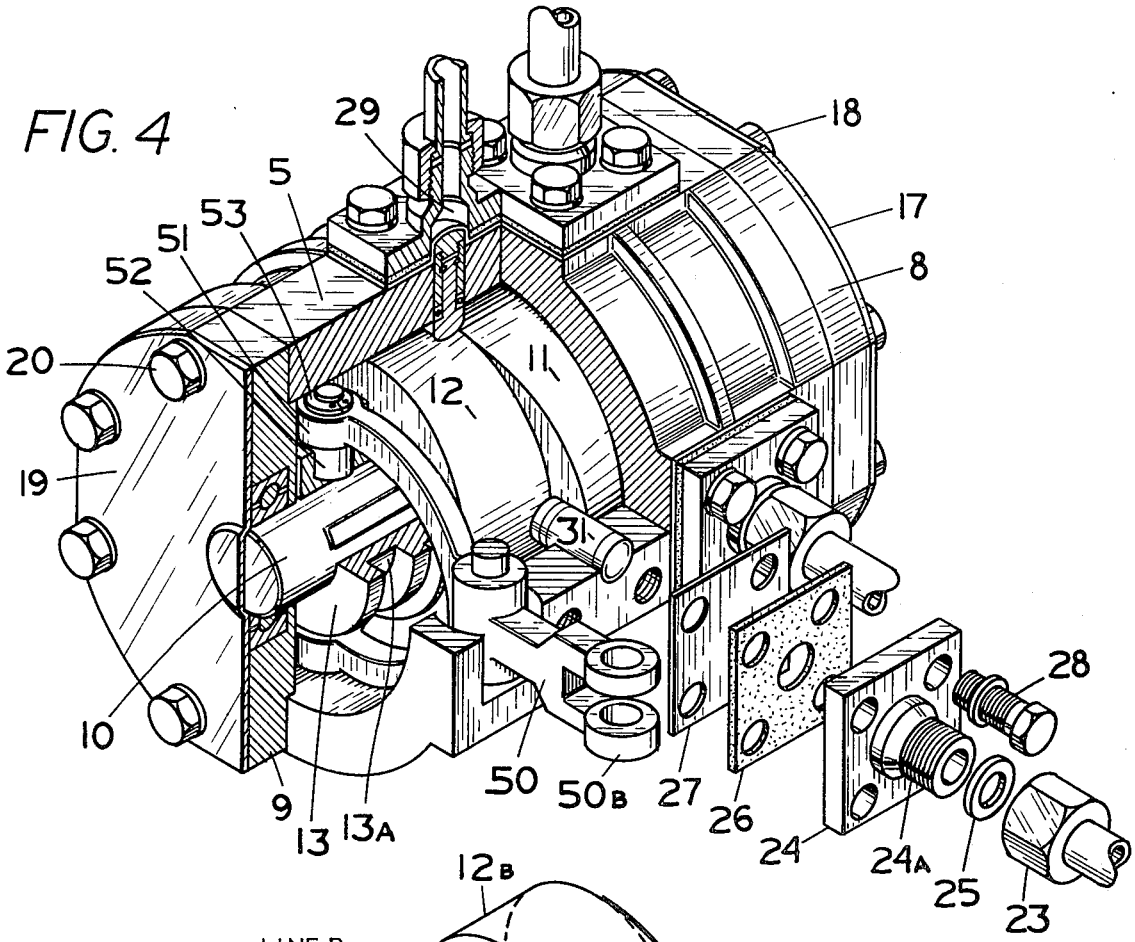
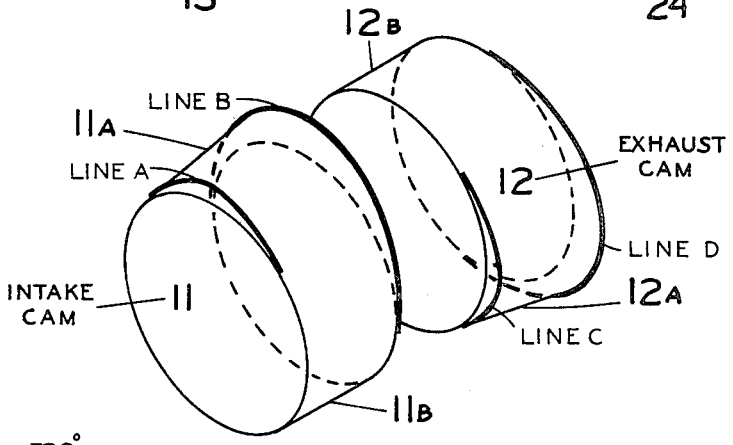
FIG. 5
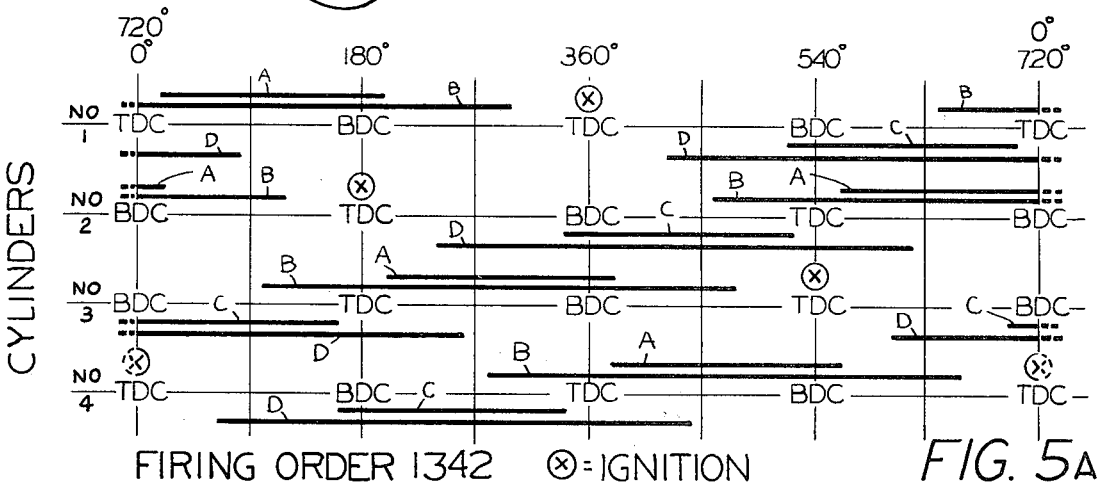
FIG. 5A

VARIABLE LIFT CAMMING APPARATUS AND METHODS OF CONSTRUCTING AND UTILIZING SAME

BACKGROUND OF THE INVENTION

1. Field of the Invention

The present invention relates generally to an apparatus for variably controlling the lift opening movements and valve opening duration periods of the intake and exhaust valves of an internal combustion engine.

The terminology "internal combustion engine" as employed herein is intended to connote all types of internal combustion engines having combustion chambers and wherein the flow of the combustible charge into the combustion chamber and the flow of burned material or exhaust gases from the combustion chamber are controlled by intake and exhaust valves. Thus, included within the terminology "internal combustion engine" is the multitude of conventional engine designs which include various types of cylinder arrangements, various cam arrangements, and either two-stroke or four-stroke cycle design.

In particular, the present invention relates to a camming apparatus wherein an intake cam member and an exhaust cam member are axially slidable responsive to the speed of the engine to provide variable control of the lift and duration of the intake and exhaust valves of the engine, with a hydraulic cam-action transmitting member being employed in transmitting camming action from the cam members to the valves.

2. Description of the Prior Art

In internal combustion engines having combustion chambers each provided with an intake and exhaust valve, various types of conventional valve operation means have heretofore been employed. Such valves are generally opened by cam action, and such cam action may be transmitted either directly against the end of the valve stems of the valves, or alternatively by a system of cooperating cam followers, push-rods and rocker arms, or other linkage members. The valves are generally closed by coil springs or the like which resist cam action. Such prior art techniques, however, inherently are afflicted with a common major disadvantage in that valve timing (the duration of lift for both intake and exhaust valves) is inflexible. In other words, the duration of lift for the valves remains the same, regardless of the rpm of the engine itself.

Such inflexibility in conventional valve operation means leads to the undesirable situation of providing optimum valve timing for the engine only within a very limited range of engine speeds, with combustion efficiency seriously decreasing at engine speeds outside of such limited optimum range. Although theoretically it is sufficient to maintain the intake valve open during the intake stroke and the exhaust valve open during the exhaust stroke, in conventional engines the valve timing is such that compromising overlap periods are provided. In other words, the intake valve is adapted to open prior to completion of the exhaust stroke in order to sufficiently fill the combustion chamber with a combustible charge and is adapted to close after the compression stroke has commenced in order to confine an increased volume of combustible mixture within the cylinder. With regard to the exhaust valve, it is adapted to open prior to the end of the expansion stroke and remains open into the intake stroke so as to purge the combustion chamber of the greatest possible amount of burned material or exhaust gases.

With such fixed overlap periods as mentioned above, engine start-up, idle and low-speed performance is seriously detrimentally affected, with incomplete combustion and high emissions levels, mainly because at low-range torque conditions best performance can only be achieved by elimination of the aforementioned fixed valve overlap. Conversely, at faster engine speeds, an increased overlap period is desirable due to increased friction and inertial forces, and increased duration and lift for the intake and exhaust valves provides increased combustible charge induction as well as providing increased purging of the exhaust gas from the chamber. Consequently, the fixed overlap periods found in conventional valve operating means represent a mere compromise between optimum low-speed and high-speed engine conditions, and the resultant inefficiency thereby produced leads to increased air pollution as well as poor engine performance.

Illustrative of prior art techniques in the field of internal combustion engine valve operation are: the "CAM SHAFT" disclosed in U.S. Pat. No. 1,651,402 issued in 1926 to Midgley; the "MEANS FOR STARTING AN INTERNAL COMBUSTION ENGINE" disclosed in U.S. Pat. No. 2,069,587 issued in 1937 to Mattern; the "METHOD AND APPARATUS FOR CONTROL OF VALVE OPERATION" disclosed in U.S. Pat. No. 3,730,150 issued in 1973 to Codner, Jr.; the "INTERNAL COMBUSTION ENGINE" disclosed in U.S. Pat. No. 3,915,129 issued in 1975 to Rust et al; and the "CAMSHAFT FOR CONTROLLING VARIABLY OPENING VALVES" issued in 1976 to Dyer.

The above-mentioned U.S. Pat. No. 3,730,150 to Codner, Jr. discloses an apparatus for controlling valve operation in an internal combustion engine by means of an axially shiftable camshaft having lobes formed with a ramp contour which varies in axial extent such that selected contours of the lobe are brought into cooperation with cam followers to provide duration and overlap periods matching desired engine performance. The valve duration periods are varied in accordance with a change in engine speed to thus increase or decrease lift duration and overlap periods, responsive to an increase or decrease in engine speed. Cam action is transmitted to the intake and exhaust valves by a conventional type of arrangement including a roller tappet with a cam-following roller. A push rod is connected to the tappet and extends to a rocker arm having an arm projecting against the valve stem. Alternatively, and also in a substantially conventional manner, in an overhead cam arrangement there is provided a hydraulic lash adjuster with a cam follower arm pivotally connected thereto. The cam follower arm serves as a lever acting against the valve stem to effect valve operation. Although the variable valve lift duration and overlap periods provided by the Codner, Jr. arrangement presents an improvement over conventional fixed valve lift duration periods, the cam action is transmitted in a substantially conventional manner from the lobes of the axially shiftable cam shaft to the valves themselves.

With conventional mechanical cam follower arrangements, such as those employed in the above-mentioned Codner, Jr. arrangement, there is normally incorporated either hydraulic lifters or hydraulic lash adjusters provided for eliminating clearance in the valve train and at the same time compensating for linear expansion and contraction due to temperature changes. The remainder of the cam action transmission means in conventional arrangements are generally mechanical, with cooperating push rods, rocker arms, etc. Generally, such conventional arrangements represent mechanically complex mechanisms which are ofttimes deficient in effectively duplicating the exact shape and lift of the cams during cam action transmission to the valve stems. Also, such conventional arrangements include a large number of moving parts, are subject to frictional forces between relatively moving parts, and generally do not present completely satisfactory and efficient means for transmission of the cam action to the valve stems.

The present invention provides an apparatus which affords a very wide range of valve lift opening movements, together with a wide range of valve opening duration periods, and generally provides more efficient valve lift control than the aforementioned prior art techniques. The apparatus according to the present invention eliminates the disadvantages and shortcomings attendant with conventional and prior art valve operating techniques, and at the same time provides an apparatus and method which employs a minimum of parts, provides maximum efficiency, and may be manufactured at a reduced costs.

SUMMARY OF THE INVENTION

The present invention provides a variable lift variable duration camming apparatus for use in an internal combustion engine provided with at least one combustion chamber having associated intake and exhaust valves. The apparatus includes a camshaft driven in time relation with the speed of the engine, the camshaft being mounted for rotational movement within an outer housing. The camshaft is provided with a first cam member for variably controlling the lift and duration of the intake valves and a second cam member for variably controlling the lift and duration of the exhaust valves, the first and second cam members being mounted for axial sliding movement on the camshaft. Shifting means adapted to cooperate with the first and second cam members are also provided, the shifting means being operated in response to the speed of the engine to axially slide the first and second to selected positions on the camshaft to permit the first and second cam members to variably control the lift and duration of the intake and exhaust valves. Each of the intake and exhaust valves is provided with associated valve operating means to open the valve for a predetermined lift duration period, the valve operating means being adapted to cooperate with the first and second cam members. The valve operating means include a cam follower member adapted to cooperate with a selected one of the first and second cam members, and hydraulic means for hydraulically transmitting motion imparted by the cam follower member to a valve stem of the valve.

It is an object of the invention to provide an apparatus for variably controlling the lift and duration of the exhaust and intake valves of an internal combustion engine, the apparatus including a first intake cam member and a second exhaust cam member both mounted on a cam mounting member which is in turn mounted for axial sliding movement on and rotation with a camshaft, the camshaft comprising a splined shaft.

A further object of the invention is to provide hydraulic cam-action transmitting means, such means comprising a fluid line having a first end thereof associated with a cam follower or lifter mechanism and a second end thereof associated with a cylinder adapted to open the valve.

Other objects and details of the invention will become apparent from the following description, when read in conjunction with the accompanying drawings.

BRIEF DESCRIPTION OF THE DRAWINGS

FIG. 4 is a perspective view of a portion of the apparatus according to the invention, as seen from the right rear of FIG. 1.

FIG. 5 is a view of the two cam members employed with the apparatus of the invention.

FIG. 5A depicts a chart of relative valve lift duration periods for the apparatus according to the invention.

DETAILED DESCRIPTION OF PREFERRED EMBODIMENTS

Figure 7:
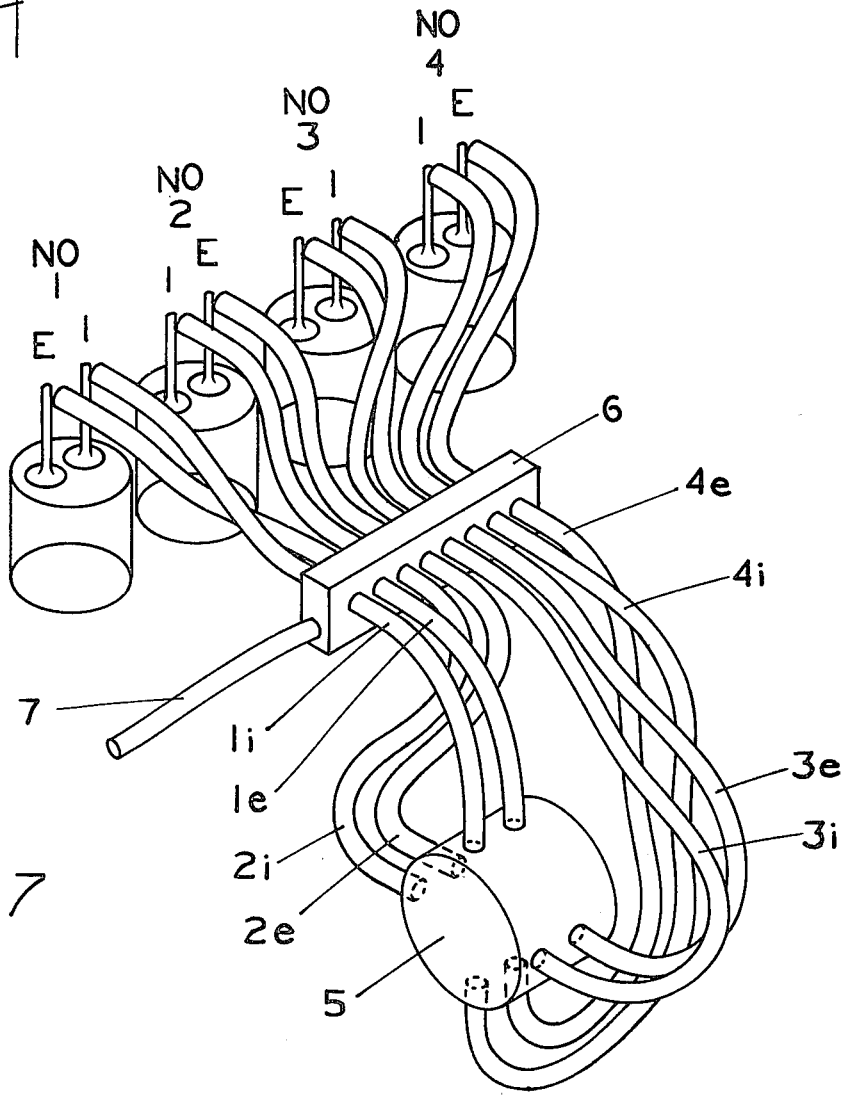
FIG. 7 depicts a perspective diagram view of the apparatus according to the invention.

With reference to FIG. 7, the apparatus in accordance with the invention is generally depicted. In the below-described embodiments of the invention, the invention is provided for use in conjunction with a four-cylinder internal combustion engine. However, it should of course be understood that the apparatus according to the invention may be adapted for use in an internal combustion engine having any number of cylinders.

The four cylinders depicted in FIG. 7 are numbered 1, 2, 3 and 4, respectively, and the cylinders are shown with the outwardly projecting valve stems associated with the intake and exhaust conventional poppet-type valves of the combustion chamber of each cylinder. The four depicted intake valve stems are each labelled "I" in FIG. 7, while the four exhaust valve stems are each labelled "E". Each of the eight valve stems depicted in FIG. 7 is provided with an associated hydraulic line member, to be discussed in greater detail hereinbelow. The hydraulic line member for each associated valve stem is indicated by the number of the associated cylinder followed by the letter "i" for intake and "e" for exhaust. Thus, the associated hydraulic lines for cylinder 1 are indicated as "1*i*" for intake and "1*e*" for exhaust, and so on with respect to cylinders 2, 3 and 4. The first end of the hydraulic lines 1*i*–4*i* and 1*e*–4*e* extends into a housing 5 as shown in FIG. 7, while the second end of each of the hydraulic lines extends into close proximity with its associated valve stem. A hydraulic line fluid supply body 6 is provided such that each of the hydraulic lines passes therethrough, and hydraulic fluid or oil under pressure is supplied from the engine or fluid pump through supply line 7 to fluid supply body 6 to replenish fluid within the hydraulic lines. The first ends of hydraulic lines 1*i*–4*i* and 1*e*–4*e* which extend into housing 5 are arranged such that the four intake hydraulic lines 1*i*, 2*i*, 3*i*, and 4*i* enter housing 5 at 90° intervals in a circumferentially-spaced manner, with each line being equidistantly spaced from the forward end of housing 5. The four exhaust hydraulic lines 1e, 2e, 3e, 4e are arranged in a like manner with the first ends thereof extending into housing 5 rearwardly of the first ends of the intake hydraulic lines 1i–4i.

Figure 1:
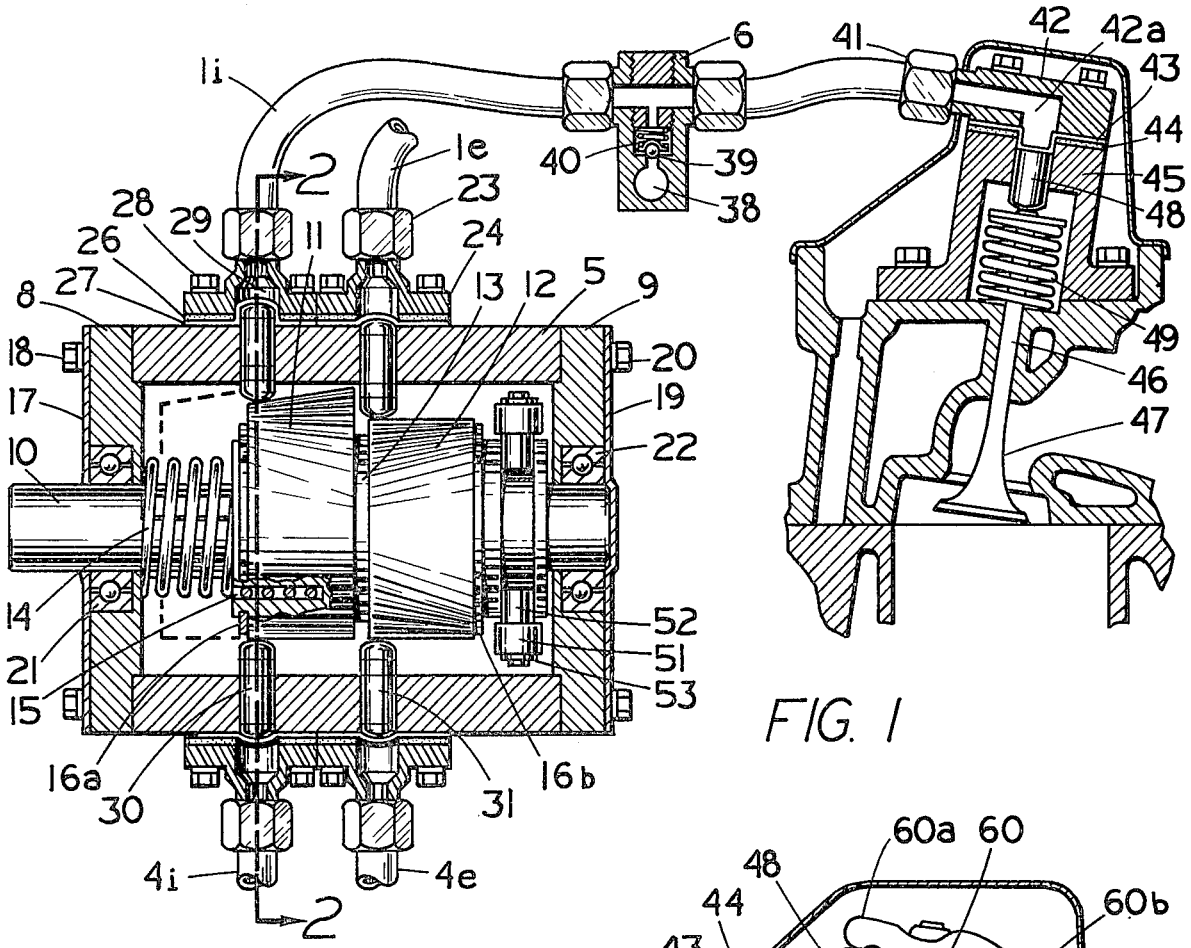
FIG. 1 is a side elevational view, partly in section, of a first embodiment of the apparatus in accordance with the invention.
Figure 2:
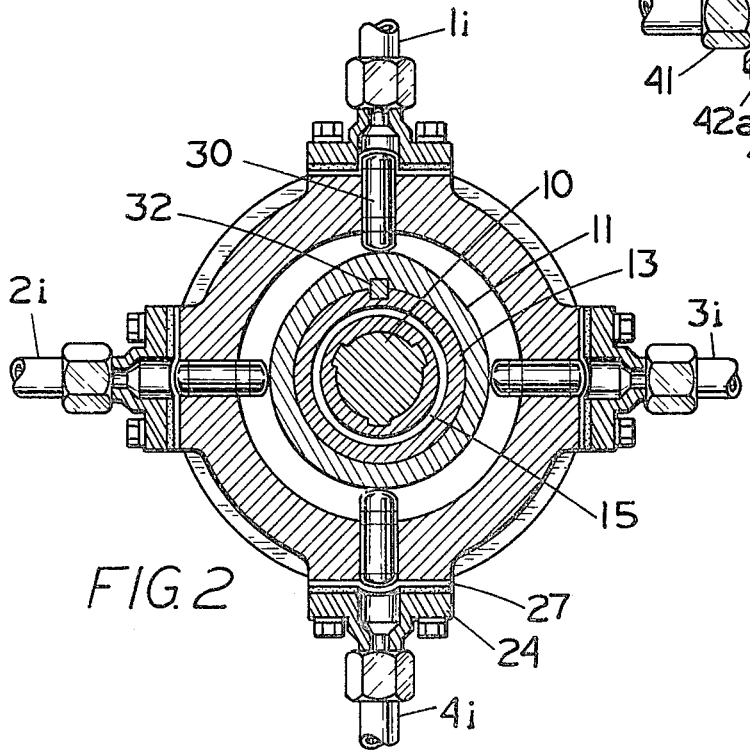
FIG. 2 is a view taken along line 2—2 of FIG. 1.

Referring now to FIGS. 1 and 2, the housing 5 with its associated components is illustrated in greater detail. Housing 5 is provided with a front end cap 8 and a rear end cap 9. A splined shaft 10, which comprises the camshaft in accordance with the invention, is mounted for rotational movement within housing 5 and is received in suitable bores provided in the end caps 8 and 9. A suitable camshaft drive system (not shown), including an intermeshing gear arrangement between the crankshaft and camshaft, for example, is provided in order that camshaft 10 may be driven at one-half the speed of the crankshaft. A front end plate and bearing retainer member 17 is secured to housing 5 by means of a mounting bolt and washer arrangement 18. Front and rear bearings 21 and 22 respectively, are provided to facilitate rotation of shaft 10.

Disposed on shaft 10 is a first cam member 11 for variably controlling the lift and duration of the intake valves, and a second cam member 12 for variably controlling the lift and duration of the exhaust valves. Cams 11 and 12 are directly fixedly disposed on an intermediate cam-mounting member 13, the forward end of which extends forwardly of cam 11 and the rearward end of which extends rearwardly of cam 12. Front and rear snap ring cam-retainers 16a and 16b, respectively, and cam-retaining key 32 (FIG. 2) are provided to ensure stationary disposition of cams 11 and 12 on cam mount 13. Cam mount 13 is in turn mounted on splined shaft 10 in a manner which permits axial sliding movement of cam mount 13 on shaft 10, but which also ensures rotation of cam mount 13 with shaft 10. A return spring 14 is disposed forwardly of cam 11 on shaft 10, and extends into suitable axial grooves 15 provided in mount 13 so as to cooperate with mount 13 in a manner to be described hereinbelow.

The hydraulic lines 1i–4i and 1e–4e shown in FIG. 7 are connected with housing 5 as shown in FIGS. 1 and 4, although only lines 1i, 1e and 4i, 4e are visible in the view of FIG. 1. Each of the first ends of the hydraulic lines is secured by a nut 23 to an intermediate hydraulic line body 24. Hydraulic line body 24 is provided with a bored and threaded connector 24a adapted to threadedly receive nut 23, and a gasket seal 25 is preferably also provided for ensuring a sealed relation between connector 24a and nut 23. Disposed beneath body 24 is a gasket member 26 which in turn has disposed therebeneath a rubber seal 27. Each of the members 24, 26 and 27 is provided with suitable apertures for receiving therethrough mounting bolts 28 which function to secure the entire assembly to housing 5 as shown in FIGS. 1 and 4. Also provided in hydraulic line body 24 is a bored portion extending below connector 24a and communicating therewith through body 24. A central aperture is provided in gasket 26 to communicate with such bored portion of body 24. However, seal 27 is continuous in that no central aperture is provided therein.

Figure 6:
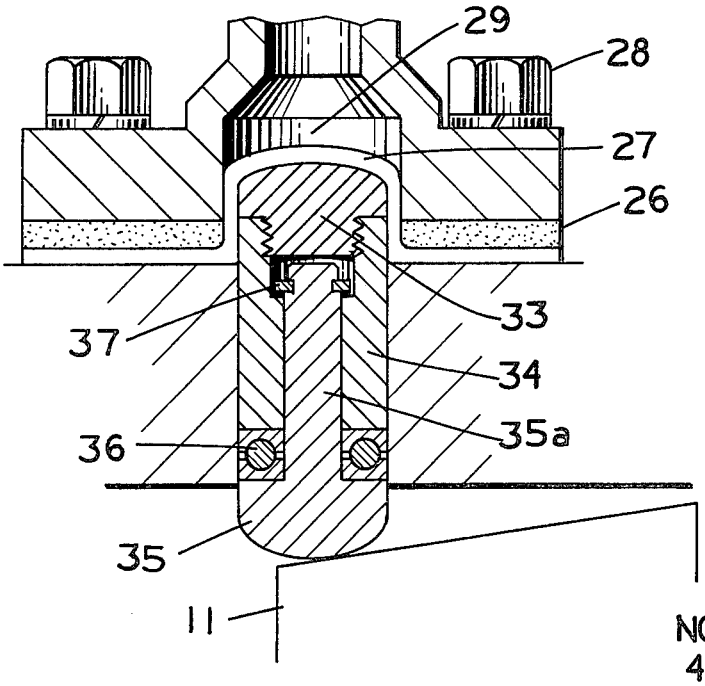
FIG. 6 illustrates a sectional view of a lifter mechanism in accordance with the invention.

With the arrangement of members 24, 26 and 27 as above described, and as shown in FIGS. 1 and 6, a passage 29 is defined between the seal 27 and nut 23 of the hydraulic lines. In this connection, there is slidably mounted in suitable bores provided in housing 5 a plurality of lifter mechanisms 30, 31, lifters 30 being associated with the intake valve operating means and lifters 31 being associated with the exhaust valve operating means. Although the lifters themselves will be described in detail hereinbelow, it will be understood with reference to FIGS. 1 and 4 that each lifter 30, 31 is associated with a hydraulic line arrangement as above described. In this connection, it should be understood that seal 27 is disposed between the outer portion of each lifter and each passage 29. Seal 27 is fabricated of substantially flexible and deformable material, preferably of rubber composition, such that upon axial sliding of each lifter within its respective bore in housing 5, when the lifter is in a raised position the outer portion thereof will press against seal 27, thus deforming same. The lifter, having the deformed portion of seal 27 surrounding the outer or top portion thereof, will be received in its raised position within passage 29, as shown in FIG. 6.

With reference to FIG. 6, there is depicted an enlarged view of a lifter mechanism 30. It should be understood that the following description of lifter 30 is equally applicable to each of the lifters 30, 31 associated with the respective intake and exhaust valves, and with the four-cylinder arrangement as shown there will be provided eight lifter mechanisms, four being associated with each cam member 11 and 12 (see FIG. 2). Each lifter includes a top lifter cap portion 33 having a curved upper surface as shown in FIG. 6. Top cap 33 is secured to the main lifter body portion 34, and body 34 is provided with a longitudinal bore adapted to receive therewithin a stem portion 35a of a lower rotating contact piece 35. Contact piece 35 is rotatably received within body 34, and bearings 36 are provided to facilitate rotation. Contact piece 35 is provided with a curved lower surface adapted to rotatably contact the camming surface of cam member 11 as shown. A snap ring retainer 37 is provided adjacent the upper portion of stem 35a of rotating contact piece 35.

Referring again to FIG. 1, the hydraulic line fluid supply body 6 is shown in greater detail. Body 6 includes an oil gallery 38 adapted to receive fluid or oil supplied under pressure from the engine or fluid pump through supply line 7 (FIG. 7). A ball check mechanism 39 is provided for controlling flow, and a ball check spring and retainer 40 cooperates therewith. Fluid supply body 6 functions in a known manner to properly supply fluid to each hydraulic line such that each line is maintained in a substantially fluid-filled operable condition. The second end of each hydraulic line, as also shown in FIG. 1, is provided a nut 41 for connection to body 42 provided with a communicating passage 42a. A rubber seal 43 and gasket 44 arrangement, substantially comparable to rubber seal 27 and gasket 26 disposed at the first end of each hydraulic line, is provided at the lower portion of passage 42a. A lower body 45 is affixed as shown to cover the valve stem 46 of poppet-type valve 47. A cylinder 48 cooperates at its lower end with the upper portion of valve stem 46, and at its upper end with deformable seal 43 as shown, and cylinder 48 is axially slidable within a suitable bore provided in body 45. A valve return spring 49 is also provided to maintain valve 47 in the normally closed spring-biased condition shown in FIG. 1.

As shown in FIGS. 1 and 4, a fork mechanism 50 is provided for axially shifting cam mounting member 13. Mount 13 is provided at the rearward portion thereof with an annular channel portion 13a as shown in FIG. 4. A U-shaped inner extending portion of fork mechanism 50, having a pair of legs 51, is adapted to cooperate with channel 13a by means of a pair of rollers 52 as shown in FIGS. 1 and 4, such that fork mechanism 50 is permitted to axially displace mount 13, with rollers 52 permitting rotation of mount 13 relative to legs 51 of fork 50. A pair of snap ring retainers 53 are provided for interconnecting legs 51 with rollers 52.

The outer portion 50*b* of fork mechanism 50 is adapted to cooperate with suitable control means which are operated responsive to engine speed. Exemplary control means which may be adapted to operate fork mechanism 50 are disclosed in the above-mentioned U.S. Pat. No. 3,730,150.

The cam members 11 and 12 will now be described in greater detail. As shown in FIG. 5, the general configuration of the intake cam 11 is substantially the same as that of exhaust cam 12. The cams are generally oblated ellipsoidally in cross section, and include peripheral lobe surface portions 11*a* and 12*a* and non-lobe surface portions 11*b* and 12*b*, respectively. As shown in FIG. 5, the distance between the axis of rotation of cams 11 and 12 and the peripheral lobe surface portions 11*a* and 12*a* thereof varies along the axial extent of cams 11 and 12. In other words, it will be seen that forward lines A and C of cams 11 and 12 respectively are closer to the axis of rotation than are rearward lines B and D respectively of cams 11 and 12 as shown in FIG. 5. Thus, the forward end of each of the cams 11 and 12 is of a lesser circumference than the rearward ends, with the circumference of the portions therebetween gradually tapering. It will be understood that the first or forward end of cams 11 and 12 (adjacent lines A and C) define a peripheral camming-surface portion particularly adapted to control the lift of the valves at low-speed, start-up and idle operation of the engine. On the other hand, the second or rearward end of cams 11 and 12 (adjacent lines B and D) define a peripheral camming-surface portion particularly adapted to control the lift of the valves at high-speed operation of the engine. Further, the peripheral lobe surface portions 11*a* and 12*a* of cams 11 and 12 are relatively angularly displaced on cam mount 13 as shown in FIGS. 5 and 1, to permit predetermined coordination of lift duration periods for the intake and exhaust valves, as described hereinbelow.

The operation of the apparatus according to the invention will now be explained with reference to FIGS. 1, 2 and 4–7.

The cam mount 13 with cams 11 and 12 disposed thereon is shown in a first low-speed, start-up or idle engine speed position in FIG. 1. In this position, the low-speed peripheral camming-surface portions of cams 11 and 12 adjacent lines A and C respectively (FIG. 5) are disposed such that lifter mechanisms 30, 31 are in contact therewith. In FIGS. 1 and 2, the peripheral lobe surface portion 11*a* is in contact with the contact piece of lifter 30 which cooperates with hydraulic line 1*i* to operate the intake valve for cylinder 1. The peripheral lobe surface portion 12*a* will not be in contact with the exhaust valve operating means for cylinder 1 at this position due to the relative angular relationship between lobe surface portions 11*a* and 12*a* as discussed with reference to FIG. 5 (the angular relationship between portions 11*a* and 12*a* and their resultant variable operation of the valves will be understood more fully hereinbelow with reference to FIG. 5A).

When the engine is operated at increasingly higher speeds, the fork mechanism 50 will function responsive to engine speed to axially shift cam mount 13 forwardly on shaft 10, against the action of return spring 14. The second or foremost position of cam mount 13 (with cams 11 and 12 disposed thereon) is indicated in dashed lines in FIG. 1, at which position the high-speed peripheral camming surface portions of cams 11 and 12 adjacent lines B and D respectively (FIG. 5) are disposed such that the contact pieces of lifter mechanisms 30, 31 are in contact therewith. As the cams 11 and 12 are shifted between their low-speed first positions and their high-speed second positions, they will of course transmit a camming action to lifter mechanisms 30, 31 by way of rotating contact lifter pieces 35 riding along the camming surfaces. In other words, axial shifting of mount 13 (with cams 11 and 12 disposed thereon) to selected positions by fork mechanism 50, moves the cams with respect to lifters 30, 31 so that the peripheral camming surface portions desired for a particular engine speed turn against the rotating contact pieces 35 of lifters 30, 31. By positioning the cam mount 13 at various positions between its extreme first and second positions, progressively varied peripheral camming surface portions are brought into operating relation with the contact pieces 35 of lifters 30, 31 to make it possible to effectively coordinate the duration and overlap periods for optimum engine performance at engine speeds in the range intermediate the low-speed and high-speed engine conditions.

As lifters 30, 31 are variably raised and lowered responsive to the aforesaid camming action, they will in turn variably deform the rubber seals 27 associated therewith. Such deformation will result in direct transmission of the camming action through the fluid-filled hydraulic lines to the deformable seal 43 adjacent the associated cylinder 48 contacting valve stem 46 of valve 47. It will thus be seen that the camming action imparted by cams 11 and 12 to lifters 30, 31 is directly and hydraulically duplicated and transmitted via hydraulic lines 1*i* –4*i* and 1*e*–4*e* by deformation of seal 27, displacement of fluid within the lines, and consequent deformation of seal 44 to cause cylinder 48 to variably lower to open valve 47 against the action of spring 49. Because the particular contours of cams 11 and 12 are essential to the precise operation of the valves, it will be seen that the hydraulic camming action transmission afforded by the cooperating lifters, hydraulic lines, deformable first and second rubber seals, and cylinders will be highly effective in precisely transmitting the camming action from the cams 11 and 12 to the valves themselves. The camming action will thus be transmitted smoothly, the cam contour will be followed precisely, and the problems associated with conventional mechanical camming-action transmitting means will be substantially eliminated.

The chart of FIG. 5A depicts the valve lift duration periods provided by cams 11 and 12 in a typical four-cylinder internal combustion engine incorporating the present invention. The indication "TDC" in the chart represents "top dead center", while "BDC" represents "bottom dead center." The firing order of the cylinders is indicated as 1, 3, 4 and 2, with ignition being indicated by ×. As seen from the chart, the intake valve lift duration period is considerably shorter at "A" (when low-speed peripheral camming surface portion adjacent line A of cam 11 is operating against the lifters) than at "B" (when high-speed peripheral camming surface portion adjacent line B of cam 11 is operating against the lifters). Likewise, the exhaust valve lift duration period is considerably shorter at "C" (when low-speed peripheral camming surface portion adjacent line C of cam 12 is operating against the lifters) than at "D" (when high-speed peripheral camming surface portion adjacent line D of cam 12 is operating against the lifters). Consequently, it will be seen that there is no overlap period between intake valve lift and exhaust valve lift at the low-speed lines marked "A" and "C" of the respective cylinders, while there is a considerable overlap period between intake valve lift and exhaust valve lift at the high-speed lines marked "B" and "D". It will also be understood in this regard that when the peripheral camming surface portions between lines A and B of cam 11 and C and D of cam 12 are progressively in turn operating against the lifters, the resultant time duration of intake and exhaust valve lift as shown in chart 5A would progressively increase from the low-speed extremes indicated by "A" and "C" to the high-speed extremes indicated by "B" and "D" on chart 5A.

Accordingly, it can thus be seen that with the apparatus in accordance with the present invention, a highly desirable wide range of valve lift opening movements and duration periods are provided to afford optimum engine performance at all speed conditions of the internal combustion engine.

Figure 3:
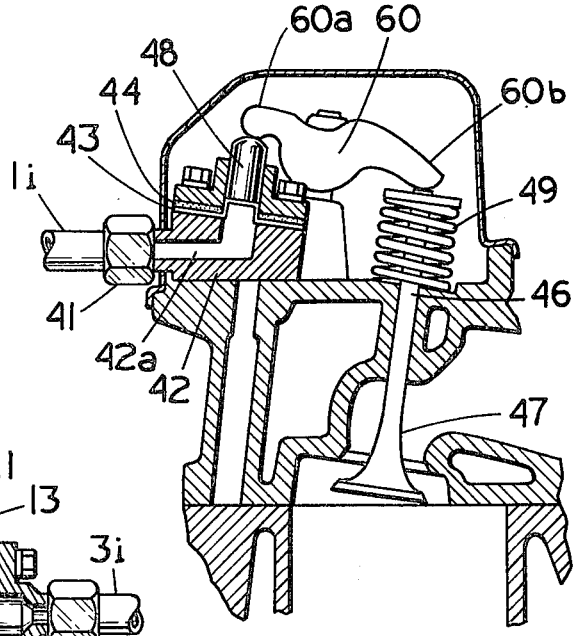
FIG. 3 is a side elevational view partly in section of a portion of the apparatus in accordance with a second embodiment of the invention.

With reference now to FIG. 3, an alternative arrangement for employing cylinder 48 to operate poppet-type valve 47 is depicted. In this embodiment, the hydraulic line (in this case line 1*i*) has its second end connected by nut 41 to body 42 having communicating passage 42*a* as described with respect to FIG. 1. A deformable seal 43 is disposed between passage 42*a* and the lower portion of axially-slidable cylinder 48, also as described with respect to FIG. 1. In this embodiment, however, rather than having cylinder 48 directly operably contact valve stem 46 of valve 47, cylinder 48 is instead adapted to operate a rocker arm 60. Rocker arm 60 is pivotally disposed in a substantially known manner such that upon upward movement of end 60*a* thereof, end 60*b* thereof will apply a downward force to valve stem 46, thus causing valve 47 to open.

In the embodiment of FIG. 3, upon the above-described deformation of seal 27, displacement of fluid in the hydraulic line, and resultant deformation of seal 43, cylinder 48 will be raised against end 60*a* of rocker arm 60, thus causing end 60*b* to in turn open valve 47 against the action of spring 49.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

I claim:

1. A variable lift camming apparatus for use in an internal combustion engine provided with at least one combustion chamber having associated intake and exhaust valves, comprising:

a camshaft driven in a timed relation with the speed of said engine, said camshaft being mounted for rotational movement within an outer housing;

said camshaft being provided with a first cam member for variably controlling the lift and duration of said intake valves and a second cam member for variably controlling the lift and duration of said exhaust valves, said first and second cam members being mounted for axial sliding movement on said camshaft;

shifting means adapted to cooperate with said first and second cam members, said shifting means being operated in response to the speed of said engine to axially slide said first and second cam members to selected positions on said camshaft to permit said first and second cam members to variably control the lift and duration of said intake and exhaust valves;

each of said intake and exhaust valves being provided with associated valve operating means to open each of said valves for a predetermined lift duration period, said valve operating means being adapted to cooperate with said first and second cam members respectively;

each said valve operating means further including a cam follower member and hydraulic means for hydraulically transmitting motion imparted by each said cam follower member to a valve stem of each of said valves;

each said cam follower member comprising an axially slidable lifter mechanism, the lower portion of said lifter mechanism including a contact piece adapted to contact a selected one of said first and second cam members;

said contact pieces of said lifter mechanisms each having a curved surface in contact with one of said cam members and being rotatable about an axis extending perpendicular to the respective one of said cam surfaces;

each said hydraulic means comprising a fluid line having a first end thereof connected adjacent the upper portion of one of said lifter mechanisms and a second end thereof extending into close proximity with one of said valves;

with said second end of each said fluid line being connected to and adapted to operate a hydraulic cylinder, each said hydraulic cylinder being operatively connected to a valve stem of one of said valves to effect operation of the latter said valve;

a first substantially flexible seal member disposed between said upper portion of each said lifter mechanism and said first end of the fluid line adjacently connected thereto, each said first seal member being adapted to be deformed by said upper portion of its associated said lifter mechanism when the latter said lifter mechanism is in a raised position;

a second substantially flexible seal member disposed between said second end of each said fluid line and its associated said hydraulic cylinder, each said second seal member being adapted to be deformed by pressurized fluid within its associated said fluid line when its associated one of said first seal members is deformed by its associated one of said lifter mechanisms; and each said hydraulic cylinder being adapted to be actuated by said deformation of its associated said second seal member to open said valve; and wherein said camshaft comprises a splined shaft adapted to have said first and second cam members mounted thereon for rotation with said camshaft.

2. A variable lift camming apparatus according to claim 1, wherein:

each said hydraulic cylinder is mounted to be axially slidable within a bore provided in a housing portion adjacent to the one of said valve stems it is connected to; and an end portion of each said hydraulic cylinder is adapted to contact the outer end of the latter said valve stem to open the valve connected to the latter stem when the latter said cylinder is actuated by said deformation of its associated said second seal member.

3. A variable lift camming apparatus according to claim 1, wherein:

each said hydraulic cylinder is mounted to be axially slidable within a bore provided in a housing portion adjacent to the one of said valve stems it is connected to;

said apparatus further includes pivotable rocker arms, each having a first end thereof adapted to contact the outer end of one of said valve stems; and an end portion of each of said hydraulic cylinders is adapted to contact a second end of a respective one of said rocker arms to open the said second seal member associated therewith by causing the latter said valve stem to open the latter said valve.

4. A variable lift camming apparatus according to claim 1, wherein:

each of said first and second cam members is formed with a peripheral lobe surface portion, and the distance between the axis of rotation of each of said cam members and said peripheral lobe surface portion of each of said cam members varies along the axial extent of each of said cam members.

5. A variable lift camming apparatus according to claim 4, wherein:

each of said first and second cam members includes a first end having a lesser circumference than a second end of said cam member;

said first end of lesser circumference of each of said cam members defines a peripheral camming surface portion particularly adapted to control the lift of said valves at startup, idle, and low-speed operation of said engine;

said second end of greater circumference of each of said cam members defines a peripheral camming surface portion particularly adapted to control the lift of said valves at high-speed operation of said engine; and said shifting means is adapted to axially slide said first and second cam members on said camshaft between a first low engine speed position wherein said first end of each of said cam members is adapted to cooperate with one of said cam follower members, and a second high engine speed position wherein said second end of each of said cam members is adapted to cooperate with the latter said one of said cam follower members, to permit said first and second cam members to variably control the lift of said intake and exhaust valves in response to the speed of said engine.

6. A variable lift camming apparatus according to claim 5, wherein:

said first and second cam members are mounted on said camshaft such that said peripheral lobe surface portion of said second cam member is disposed at a predetermined angular relation with respect to said peripheral lobe surface portion of said first cam member to permit predetermined coordination of lift duration periods of said intake and exhaust valves.

7. A variable lift camming apparatus according to claim 6, wherein:

an intermediate cam mounting member is disposed between said first and second cam members and said splined shaft, said first and second cam members being mounted on said intermediate cam mounting member for rotation therewith;

said cam mounting member being mounted for axial sliding movement on said splined shaft and for rotation with said splined shaft; and said shifting means includes a fork member adapted to cooperate with a portion of said cam mounting member to axially slide said cam mounting member having said first and second cam members mounted thereon.

* * * * *